US008722598B2

(12) United States Patent
Akiyama et al.

(10) Patent No.: US 8,722,598 B2
(45) Date of Patent: May 13, 2014

(54) GREASE COMPOSITION FOR BEARINGS WITH IMPROVED HEAT-RESISTANT ACOUSTIC LIFE

(75) Inventors: Motoharu Akiyama, Kitasaku-gun (JP); Yusuke Enomoto, Kitasaku-gun (JP); Kenichiro Matsubara, Fujisawa (JP)

(73) Assignees: Kyodo Yushi Co., Ltd., Kanagawa (JP); Minebea Co., Ltd., Nagano (JP)

( * ) Notice: Subject to any disclaimer, the term of this patent is extended or adjusted under 35 U.S.C. 154(b) by 0 days.

(21) Appl. No.: 13/458,011

(22) Filed: Apr. 27, 2012

(65) Prior Publication Data

US 2012/0277136 A1 Nov. 1, 2012

(30) Foreign Application Priority Data

Apr. 28, 2011 (JP) ..... 2011-100428

(51) Int. Cl.
*C10M 105/34* (2006.01)
*C10M 169/04* (2006.01)
*C10M 133/12* (2006.01)

(52) U.S. Cl.
USPC ..... 508/463; 508/487; 508/539; 508/545; 508/563

(58) Field of Classification Search
USPC ..... 508/463, 539, 487, 545, 563
See application file for complete search history.

(56) References Cited

U.S. PATENT DOCUMENTS

| | | | | |
|---|---|---|---|---|
| 3,247,111 | A * | 4/1966 | Hepplewhite et al. | 508/209 |
| 6,656,888 | B1 * | 12/2003 | Zehler | 508/485 |
| 2008/0317964 | A1 * | 12/2008 | Burgo et al. | 427/427.5 |

FOREIGN PATENT DOCUMENTS

| | | |
|---|---|---|
| JP | 4-117445 | 4/1992 |
| JP | 4117445 B2 | 5/2008 |
| JP | 2008-143979 | 6/2008 |

* cited by examiner

*Primary Examiner* — Cephia D. Toomer
*Assistant Examiner* — Vishal Vasisth
(74) *Attorney, Agent, or Firm* — Nixon & Vanderhye P.C.

(57) ABSTRACT

The invention provides a grease composition having (A) a lithium soap thickener, (B) as a base oil an ester type synthetic oil obtainable from an esterification reaction of trimethylolpropane with a fatty acid, and (C) (c-1) a 1-naphthylamine type antioxidant and (c-2) a diphenylamine type antioxidant, wherein the contents of (c-1) and (c-2) are 1.0 to 10 mass % in total, based on the total mass of the composition, and the ratio by mass of (c-1) to (c-2) is in the range from 30:70 to 70:30.

4 Claims, No Drawings

GREASE COMPOSITION FOR BEARINGS WITH IMPROVED HEAT-RESISTANT ACOUSTIC LIFE

This application claims priority to Japan Application No. 2011-100428, filed 28 Apr. 2011, the entire content of which is hereby incorporated by reference.

FIELD OF THE INVENTION

The present invention relates to a grease composition comprising a lithium soap thickener; as a base oil an ester type synthetic oil comprising trimethylolpropane; and specified antioxidants. More particularly, the invention relates to a grease composition that is suitable for use in the bearings, especially in the rolling bearings of small motors.

BACKGROUND OF THE INVENTION

Higher comfort, electric power saving and durability have been sought for the motors of household electrical appliances and information appliances, such as brushless motors, fan motors and the like. Especially, for the bearings of the small motors used in the household electrical appliances, a grease composition is required to have low noise performance and acoustic long life.

A grease composition is disclosed which is designed to achieve the low noise performance and the acoustic long life by adding a detergent dispersant to the grease composition to prevent the wear debris caused by running-in wear from adhering to the rolling surfaces (JP4117445B). There is disclosed another grease composition that is designed to upgrade the initial acoustic property and also prevent the acoustic property from deteriorating with the passage of time and under the conditions of high temperatures by using a urea based thickener having a particular composition in combination with a particular organic sulfonate (JP 2008-143979 A).

However, the demand for improvement in the acoustic life under the conditions of high temperatures has still been increasing with respect to the rolling bearings incorporated into the small motors for the household electrical appliances and information appliances.

SUMMARY OF THE INVENTION

An object of the invention is to provide a grease composition having a heat-resistant acoustic long life that is suitable for use in the rolling bearings of small motors.

The present invention provides a grease composition shown below:

1. A grease composition comprising;

(A) a lithium soap thickener, (B) as a base oil an ester type synthetic oil obtainable from an esterification reaction of trimethylolpropane with a fatty acid, and (C) (c-1) a 1-naphthylamine type antioxidant and (c-2) a diphenylamine type antioxidant, wherein the contents of (c-1) and (c-2) are 1.0 to 10 mass % in total, based on the total mass of the composition, and the ratio by mass of (c-1) to (c-2) is in the range from 30:70 to 70:30.

2. The grease composition described in the above-mentioned item 1, wherein (c-1) the 1-naphthylamine type antioxidant is a compound represented by the following formula (I):

(I)

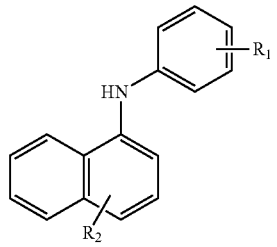

wherein $R_1$ and $R_2$ are each independently a hydrogen atom or a straight-chain or branched alkyl group having 1 to 12 carbon atoms.

3. The grease composition described in the above-mentioned item 1 or 2, wherein (c-2) the diphenylamine type antioxidant is a compound represented by the following formula (II):

(II)

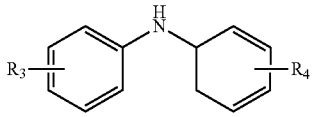

wherein $R_3$ and $R_4$ are each independently a hydrogen atom or a straight-chain or branched alkyl group having 1 to 12 carbon atoms.

4. The grease composition described in any one of the above-mentioned items 1 to 3, wherein the ester type synthetic oil (B) is an ester type oil obtainable from an esterification reaction of trimethylolpropane with a mixture of straight-chain and branched fatty acids having 6 to 20 carbon atoms.

5. The grease composition described in any one of the above-mentioned items 1 to 4, wherein the lithium soap thickener (A) is lithium 12-hydroxystearate.

Effects of Invention

The grease composition of the invention is excellent in heat-resistant acoustic life. The grease composition of the invention is also excellent in the initial acoustic property. Such acoustic properties produce an advantageous result particularly in the rolling bearings of the small motors.

DETAILED DESCRIPTION OF THE INVENTION

<Components of Grease Composition>

[(A) Lithium Soap Thickener]

The lithium soap thickener used for the grease composition of the invention is practical because of less disadvantages and lower cost. Particularly, lithium laurate, lithium stearate or lithium 12-hydroxystearate is preferable, lithium laurate or lithium 12-hydroxystearate is more preferable, and lithium 12-hydroxystearate is most preferable. The grease composition of the invention containing such a lithium soap thickener is excellent in the low noise performance.

The grease composition of the invention has preferably a consistency or penetration of 200 to 400, so that the thickener may be contained in such an amount that can satisfy the above-mentioned consistency. The thickener may preferably be contained in an amount of 3 to 30 mass %, more preferably 5 to 20 mass %, and most preferably 7 to 15 mass %, based on the total mass of the grease composition of the invention.

[(B) Base Oil]

The base oil used in the grease composition of the invention is an ester type synthetic oil that can be prepared using trimethylolpropane as an alcohol. The fatty acid for constituting the ester type synthetic base oil includes straight-chain or branched fatty acids having 6 to 20 carbon atoms, preferably 6 to 18 carbon atoms. The fatty acids may be used alone or as a mixture thereof. The mixture of fatty acids is desirable, and a mixture of a straight-chain fatty acid and a branched fatty acid is more desirable. The use of a straight-chain fatty acid in combination with a branched fatty acid can result in better fluidity at low temperatures than single use of a straight-chain fatty acid. The fatty acid may be saturated or unsaturated, but the saturated fatty acid is preferred.

In particular, an ester type synthetic oil obtainable from trimethylolpropane and a mixture of a straight-chain saturated fatty acid having 6 to 12 carbon atoms and a branched saturated fatty acid having 16 to 18 carbon atoms may preferably be used. The most preferable ester type synthetic oil is an ester type oil prepared from trimethylolpropane and a mixture of n-octanoic acid, n-decanoic acid, and i-stearic acid.

The kinetic viscosity of the base oil at 40° C. may preferably be in the range of 10 to 50 $mm^2/s$, and more preferably 15 to 35 $mm^2/s$.

[(C) Antioxidants]

According to the invention, (c-1) a 1-naphthylamine type antioxidant and (c-2) a diphenylamine type antioxidant are used as the essential components.

The (c-1) and (c-2) are totally contained in an amount of 1.0 to 10 mass %, preferably 2.0 to 6.0 mass %, based on the total mass of the composition. When the total amount of (c-1) and (c-2) is within the above-mentioned range, the heat-resistant acoustic life performance will be excellent.

The ratio by mass of (c-1) the 1-naphthylamine type antioxidant to (c-2) the diphenylamine type antioxidant is from 30:70 to 70:30. When the mixing ratio of (c-1) to (c-2) is within the above specified range, a small amount thereof can produce excellent heat-resistant acoustic life performance.

As (c-1) the 1-naphthylamine type antioxidant, a compound represented by the following formula (I) is preferred:

(I)

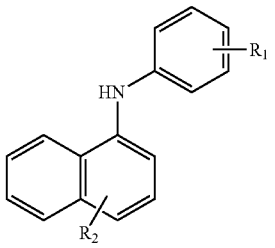

wherein $R_1$ and $R_2$ are each independently a hydrogen atom or a straight-chain or branched alkyl group having 1 to 12 carbon atoms.

Examples of the straight-chain or branched alkyl group represented by $R_1$ and $R_2$ are methyl, ethyl, n-propyl, i-propyl, n-butyl, i-butyl, t-butyl, n-pentyl, i-pentyl, neopentyl, t-pentyl, 2-methylbutyl, n-hexyl, i-hexyl, 3-methylpentyl, ethylbutyl, n-heptyl, 2-methylhexyl, n-octyl, i-octyl, 2-ethylhexyl, 3-methylheptyl, 1,1,3,3-tetramethylbutyl, n-nonyl, i-nonyl, 1-methyloctyl, ethylheptyl, n-decyl, 1-methylnonyl, n-undecyl, 1,1-dimethylnonyl, n-dodecyl and the like.

In the formula (I), $R_1$ may preferably represent a hydrogen atom, and $R_2$ may preferably represent a branched alkyl group having 1 to 12 carbon atoms, more preferably a branched alkyl group having 3 to 10 carbon atoms. In particular, 1,1,3,3-tetramethylbutyl group is preferred. Most preferably, $R_1$ may represent a hydrogen atom, and $R_2$ may represent 1,1,3,3-tetramethylbutyl group.

Preferably, $R_1$ may be bonded to phenyl group at the 4-position, and $R_2$ may be bonded to naphthyl group at the 6-position.

As the compound of formula (I), N-phenyl-1,1,3,3-tetramethylbutylnaphthalene-1-amine is preferable.

In the grease composition of the invention, the 1-naphthylamine type antioxidant may be used alone or in combination thereof.

As (c-2) the diphenylamine type antioxidant, the following compound represented by formula (II) is preferable:

(II)

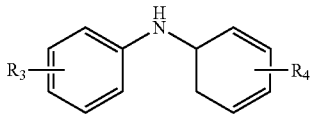

wherein $R_3$ and $R_4$ are each independently a hydrogen atom or a straight-chain or branched alkyl group having 1 to 12 carbon atoms.

Examples of the straight-chain or branched alkyl group represented by $R_3$ and $R_4$ are methyl, ethyl, n-propyl, i-propyl, n-butyl, i-butyl, t-butyl, n-pentyl, i-pentyl, neopentyl, t-pentyl, 2-methylbutyl, n-hexyl, i-hexyl, 3-methylpentyl, ethylbutyl, n-heptyl, 2-methylhexyl, n-octyl, i-octyl, 2-ethylhexyl, 3-methylheptyl, 1,1,3,3-tetramethylbutyl, n-nonyl, i-nonyl, 1-methyloctyl, ethylheptyl, n-decyl, 1-methylnonyl, n-undecyl, 1,1-dimethylnonyl, n-dodecyl and the like.

The alkyl groups represented by $R_3$ and $R_4$ can be each bonded to phenyl group at any position, but preferably at the p-positions with respect to the amino group. More preferably, the compound of formula (II) may be p,p'-dioctyldiphenylamine where $R_3$ and $R_4$ are each i-octyl group.

In the grease composition of the invention, the diphenylamine type antioxidant may be used alone or in combination thereof.

When necessary, the grease composition of the invention may further comprise various additives commonly used for grease compositions in addition to the above-mentioned essential components. For example, a rust preventive, metal deactivator, detergent dispersant, extreme pressure agent, anti-foam agent, antiemulsifier, oiliness improver, antiwear agent, solid lubricant and the like can be used as the additives. Those additives may be generally used in an amount of 0.01 to 10 mass %.

The grease composition of the invention can advantageously be used for the rolling bearings, in particular, the rolling bearings in the small motors (e.g., brushless motors and fan motors) of household electrical appliances and information appliances.

The invention will now be explained more specifically by referring to the following examples.

EXAMPLES

Sample Grease Compositions

Examples 1 to 5 and Comparative Examples 1 to 7

Lithium 12-hydroxystearate was mixed and dissolved in a base oil shown below under application of heat, and then the resultant mixture was cooled to obtain a base grease. The predetermined amounts of antioxidants were mixed with a base oil, which was added to the base grease, and the resultant mixture was well mixed and kneaded using a three-roll mill, thereby preparing a grease composition having a worked penetration of 250 (JIS K2220).

Comparative Example 8

Diphenylmethanediisocyanate was reacted with cyclohexylamine and stearylamine in a base oil to prepare a base grease. Predetermined amounts of antioxidants were mixed with a base oil, which was added to the base grease, and the resultant mixture was well mixed and kneaded using a three-roll mill, thereby preparing a grease composition having a worked penetration of 250 (JIS K2220).

<Test Methods>

1. Methods for Evaluating the Initial Acoustic Property and the Heat-Resistant Acoustic Life Property Each sample grease composition was enclosed in a ball bearing with a steel shield (having an inner diameter of 8 mm, an outer diameter of 22 mm and a width of 7 mm) so that the grease fill amount might be 25 to 35% of the total bearing volume. Two ball bearings were mounted in a housing, and then a preload of about 40 N was applied to each bearing. A shaft was inserted into the inner diameters of the bearings and connected to the rotating shaft of a testing motor so as to allow the inner ring of the ball bearing to rotate. Subsequently, the ball bearing was placed in a thermostatic chamber. The evaluation test was conducted in such a manner that the testing motor was rotated at 3000 rpm for 1500 hours at a temperature of 110° C. Each grease composition obtained in Examples and Comparative Examples was subjected to the evaluation test using ten ball bearings to take an average.

Using the machine called Anderon meter, the acoustic properties before and after rotation of the bearing were evaluated by determining the vibration of a medium band (i.e., M band with a frequency range of 300 to 1800 Hz) as the unit called Anderon. The initial acoustic property was expressed as the Anderon value obtained before rotating the bearing; and the heat-resistant acoustic life property was evaluated as the Anderon value obtained after rotating the bearing for 1500 hours. The vibration of the M band with a frequency range of 300 to 1800 Hz is regarded as unpleasant sound and offensive to the ear.

2. Evaluation Criteria for Initial Acoustic Property o: average Anderon value of less than 0.3 x: average Anderon value of 0.3 or higher

3. Evaluation Criteria for Heat-Resistant Acoustic Life Property o: average Anderon value of less than 5 x: average Anderon value of 5 or higher

The results are shown in Table 1. In Table 1, the term "mass %" is based on the total mass of the composition.

TABLE 1

| | | Example 1 | Example 2 | Example 3 | Example 4 | Example 5 |
|---|---|---|---|---|---|---|
| Thickener | | Li 12-hydroxy stearate | Li 12-hydroxy stearate | Li 12-hydroxy stearate | Li 12-hydroxy stearate | Li 12-hydroxy stearate |
| Base oil | Ester type oil A | ○ | ○ | ○ | ○ | ○ |
| | Ester type oil B | | | | | |
| Anti-oxidant | Antioxidant A (mass %) | 1.0 | 1.0 | 2.0 | 2.0 | 3.0 |
| | Antioxidant B (mass %) | 1.0 | 2.0 | 1.0 | 2.0 | 3.0 |
| | Antioxidant C (mass %) | | | | | |
| | A + B (mass %) | 2.0 | 3.0 | 3.0 | 4.0 | 6.0 |
| | A:B (ratio by mass) | 50:50 | 33:67 | 67:33 | 50:50 | 50:50 |
| Initial acoustic property | | ○ | ○ | ○ | ○ | ○ |
| Heat-resistant acoustic life property | | ○ | ○ | ○ | ○ | ○ |

| | | Com. Ex. 1 | Com. Ex. 2 | Com. Ex. 3 | Com. Ex. 4 |
|---|---|---|---|---|---|
| Thickener | | Li 12-hydroxy stearate | Li 12-hydroxy stearate | Li 12-hydroxy stearate | Li 12-hydroxy stearate |
| Base oil | Ester type oil A | ○ | | ○ | ○ |
| | Ester type oil B | | ○ | | |
| Anti-oxidant | Antioxidant A (mass %) | 2.0 | 1.0 | 0.3 | 7.0 |
| | Antioxidant B (mass %) | 0 | 1.0 | 0.3 | 7.0 |
| | Antioxidant | 1.0 | | | |

TABLE 1-continued

| | | | | | |
|---|---|---|---|---|---|
| | C (mass %) | | | | |
| | A + B (mass %) | 3.0 | 2.0 | 0.6 | 14.0 |
| | A:B (ratio by mass) | — | 50:50 | 50:50 | 50:50 |
| Initial acoustic property | | ○ | ○ | ○ | x |
| Heat-resistant acoustic life property | | x | x | x | — |

| | | Com. Ex. 5 | Com. Ex. 6 | Com. Ex. 7 | Com. Ex. 8 |
|---|---|---|---|---|---|
| Thickener | | Li 12-hydroxy stearate | Li 12-hydroxy stearate | Li 12-hydroxy stearate | Urea |
| Base oil | Ester type oil A | ○ | ○ | ○ | ○ |
| | Ester type oil B | | | | |
| Anti-oxidant | Antioxidant A (mass %) | 0.4 | 1.6 | 4.0 | 2.0 |
| | Antioxidant B (mass %) | 1.6 | 0.4 | 0 | 2.0 |
| | Antioxidant C (mass %) | | | | |
| | A + B (mass %) | 2.0 | 2.0 | 4.0 | 4.0 |
| | A:B (ratio by mass) | 20:80 | 80:20 | — | 50:50 |
| Initial acoustic property | | ○ | ○ | ○ | ○ |
| Heat-resistant acoustic life property | | x | x | x | x |

Base Oils

Ester type oil A: an ester type oil prepared from trimethylolpropane and a mixture of n-octanoic acid, n-decanoic acid and i-stearic acid (having a kinetic viscosity of 25 $mm^2/s$ at 40° C.).

Ester type oil B: combination of pentaerythritol ester oil and diester (having a kinetic viscosity of 25 $mm^2/s$ at 40° C.).

In the above, the kinetic viscosity at 40° C. was determined in accordance with the method of JIS K2220 23.

Antioxidants

Antioxidant A: Alkylated N-phenyl-1-naphthylamine (Cas No. 68259-36-9)

Antioxidant B: Alkylated diphenylamine (Cas No. 68411-46-1)

Antioxidant C: Hindered phenol type antioxidant (Cas No. 2082-79-3)

In Examples 1 to 5 where the lithium soap thickener, the ester type synthetic oil (ester type oil A) prepared from an esterification reaction of trimethylolpropane with fatty acids, the 1-naphthylamine type antioxidant (antioxidant A), and the diphenylamine antioxidant (antioxidant B) were contained in the predetermined amounts at the given mixing ratios, any grease compositions produced excellent results in terms of the initial acoustic property and the heat-resistant acoustic life property.

In Comparative Example 1 where the antioxidant B used in Example 3 was replaced by the antioxidant C in the same amount, the heat-resistant acoustic life property became inferior.

In Comparative Example 2 where the base oil used in Example 1 was replaced by the ester type oil B, the heat-resistant acoustic life property became inferior.

In Comparative Example 3 where the total amount of the antioxidants A and B was 0.6 mass %, which was lower than specified by the invention, the heat-resistant acoustic life property became inferior.

In Comparative Example 4 where the total amount of the antioxidants A and B was 14 mass %, which was higher than specified by the invention, the initial acoustic property became inferior.

In both of Comparative Examples 5 and 6 where the mixing ratio of the antioxidant A to the antioxidant B was not within the range specified by the invention (the contents of the antioxidants A and B were respectively 0.4 mass % and 1.6 mass % in Comparative Example 5, and the contents of the antioxidants A and B were respectively 1.6 mass % and 0.4 mass % in Comparative Example 6) although the total amount of the antioxidants A and B was the same as in Example 1, the heat-resistant acoustic life property became inferior.

In Comparative Example 7 where the antioxidant B was not used, but the antioxidant A was contained in the same amount as the total amount of the antioxidants A and B in Example 4, the heat-resistant acoustic life property became inferior.

In Comparative Example 8 using the urea thickener differently from Example 4, the heat-resistant acoustic life property became inferior.

As can be seen from the above results, it has been clarified that the grease composition of the invention is provided with both excellent initial acoustic property and heat-resistant acoustic life property.

What is claimed is:

1. A grease composition comprising;

(A) a lithium soap thickener, (B) as a sole base oil, an ester type synthetic oil obtainable from trimethylolpropane and a mixture of a straight-chain saturated fatty acid having 6 to 12 carbon atoms and a branched saturated fatty acid having 16 to 18 carbon atoms, and (C) (c-1) a 1-naphthylamine type antioxidant represented by formula (I):

(I)

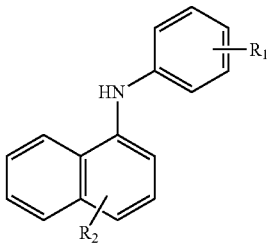

wherein $R_1$ is a hydrogen atom and $R_2$ is a straight-chain or branched alkyl group having 1 to 12 carbon atoms, and (c-2) a diphenylamine type antioxidant, wherein the total content of (c-1) and (c-2) is in the range from 2.0 to 6.0 mass %, based on the total mass of the grease composition, and the ratio by mass of (c-1) to (c-2) is in the range from 30:70 to 70:30, wherein (c-2) the diphenylamine type antioxidant is a compound represented by formula (II):

(II)

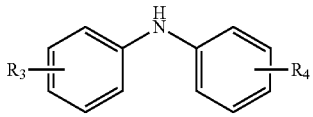

wherein $R_3$ and $R_4$ are each independently a hydrogen atom or a straight-chain or branched alkyl group having 1 to 12 carbon atoms.

2. The grease composition of claim 1, wherein the lithium soap thickener (A) is lithium 12-hydroxystearate.

3. The grease composition of claim 1, wherein the ester type synthetic oil is prepared from trimethylolpropane and a mixture of n-octanoic acid, n-decanoic acid, and i-stearic acid.

4. The grease composition of claim 1, wherein (c-1) the 1-naphthylamine type antioxidant is N-phenyl-1,1,3,3-tetramethylbutylnaphthalene-1-amine.

* * * * *